US007868854B2

(12) United States Patent
Kanda

(10) Patent No.: US 7,868,854 B2
(45) Date of Patent: Jan. 11, 2011

(54) ELECTRO-OPTICAL DEVICE AND ELECTRONIC APPARATUS

(75) Inventor: Eiji Kanda, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 804 days.

(21) Appl. No.: 11/776,827

(22) Filed: Jul. 12, 2007

(65) Prior Publication Data

US 2008/0062092 A1 Mar. 13, 2008

(30) Foreign Application Priority Data

Sep. 13, 2006 (JP) ..... 2006-247654

(51) Int. Cl.
*G09G 3/30* (2006.01)

(52) U.S. Cl. ..... 345/77

(58) Field of Classification Search ..... 345/76–83
See application file for complete search history.

(56) References Cited

U.S. PATENT DOCUMENTS

| | | | | |
|---|---|---|---|---|
| 6,229,506 | B1 | 5/2001 | Dawson et al. | |
| 6,876,345 | B2 | 4/2005 | Akimoto et al. | |
| 7,142,180 | B2 | 11/2006 | Akimoto et al. | |
| 7,277,072 | B2 | 10/2007 | Akimoto et al. | |
| 2003/0214465 | A1* | 11/2003 | Kimura | 345/76 |
| 2005/0237273 | A1* | 10/2005 | Ozawa et al. | 345/46 |
| 2006/0176251 | A1* | 8/2006 | Park et al. | 345/76 |
| 2008/0007493 | A1 | 1/2008 | Akimoto et al. | |

FOREIGN PATENT DOCUMENTS

| | | |
|---|---|---|
| JP | A-2003-005709 | 1/2003 |
| JP | A 2004-133240 | 4/2004 |
| JP | A 2004-246204 | 9/2004 |
| JP | A-2005-309150 | 11/2005 |
| JP | A 2006-349794 | 12/2006 |

* cited by examiner

*Primary Examiner*—Richard Hjerpe
*Assistant Examiner*—Jeffrey Parker
(74) *Attorney, Agent, or Firm*—Oliff & Berridge PLC

(57) ABSTRACT

An electro-optical device includes a plurality of data lines, a plurality of scanning lines, a plurality of unit circuits that are provided in correspondence with intersections of the data lines and the scanning lines. Each of the data lines is supplied with a data voltage in accordance with a gray-scale level. Each of the scanning lines is supplied with a scanning signal that specifies a writing period during which the data voltage is being written into the corresponding unit circuits. Each of the plurality of unit circuits includes a driving transistor, an electro-optical element, a capacitive element, a power feed line, a first switching element and a second switching element. The driving transistor generates a driving current in accordance with an electric potential of a gate thereof. The electro-optical element generates light with a gray-scale level in accordance with the driving current that is generated by the driving transistor. The capacitive element has a first electrode and a second electrode that is connected to the gate of the driving transistor. The power feed line is supplied with a constant electric potential and is, during an initialization period that is different from the writing period, electrically connected to the second electrode. The first switching element conducts the gate of the transistor with the drain thereof at least during the initialization period. The second switching element switches between conduction and non-conduction between the data line and the first electrode on the basis of the scanning signal. The power feed line is arranged in a direction that intersects with the scanning lines.

9 Claims, 10 Drawing Sheets

FIG. 5 [RESET PERIOD Pa (INITIALIZATION PERIOD $P_{INT}$)]
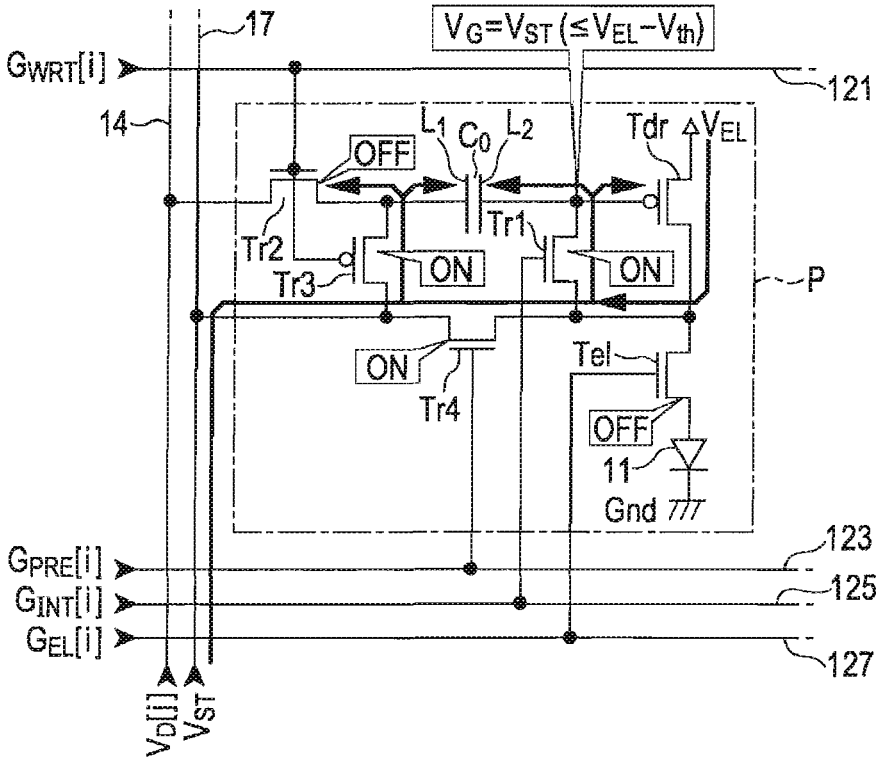
FIG. 6 [COMPENSATION PERIOD Pb (INITIALIZATION PERIOD $P_{INT}$]
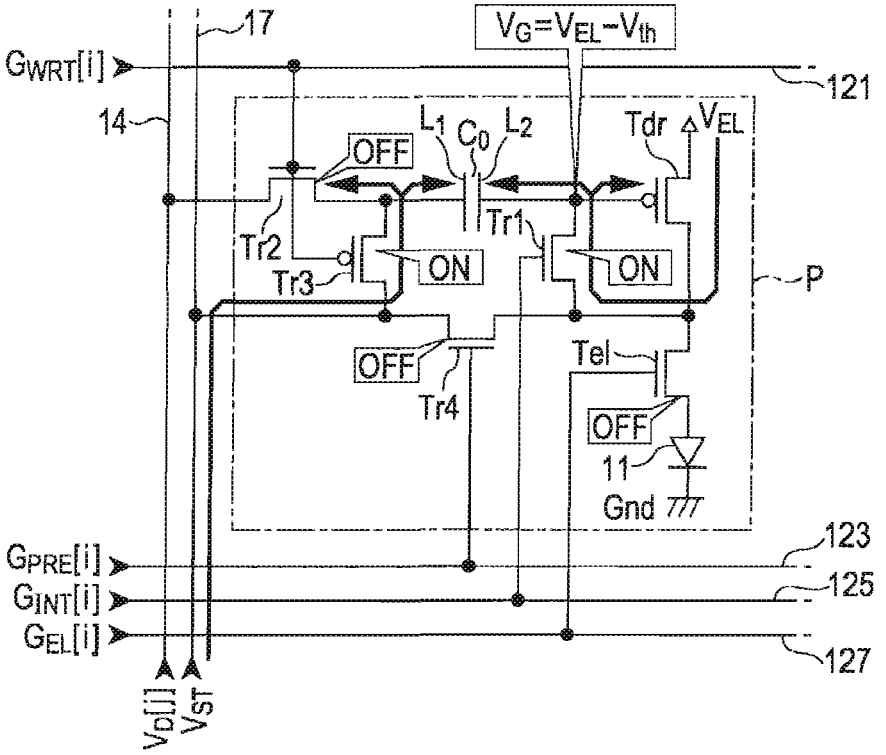

FIG. 7 [WRITING PERIOD $P_{WRT}$]
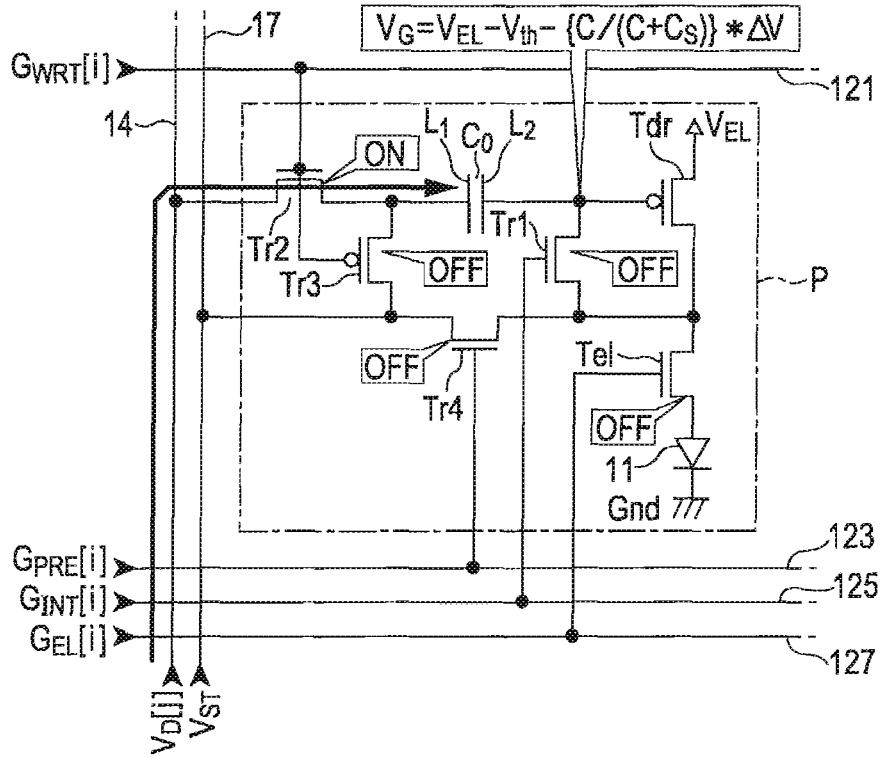
FIG. 8 [LIGHT EMISSION PERIOD $P_{EL}$]
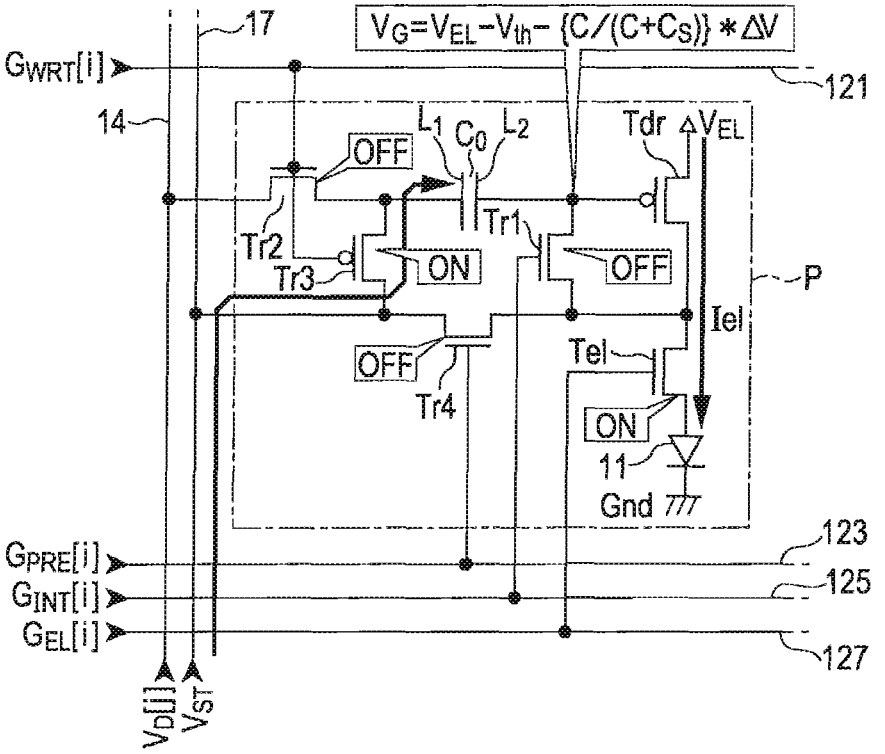

[MEASUREMENT PERIOD $P_T$]

ELECTRO-OPTICAL DEVICE AND ELECTRONIC APPARATUS

BACKGROUND

The entire disclosure of Japanese Patent application No. 2006-247654, filed Sep. 13, 2006 is expressly incorporated by reference herein.

1. Technical Field

The present invention relates to a technology that controls the operations of various electro-optical elements, such as light-emitting devices made of organic EL (ElectroLuminescent) material.

2. Related Art

In electro--optical elements made of organic EL material, gray-scale level (typically, luminance) is changed in accordance with an electric current supplied thereto. A configuration for controlling the electric current (hereinafter, referred to as "driving current") by means of a transistor (hereinafter, referred to as "driving transistor") has been proposed. However, this configuration is disadvantageous in that electro-optical elements have nonuniform gray-scale levels due to individual differences in characteristics (particularly, in threshold voltage) among driving transistors. A configuration for compensating for differences in threshold voltage among driving transistors in order to suppress such nonuniform gray-scale levels is disclosed, for example, in U.S. Pat. No. 6,229,506 (FIG. 2) and Japanese Unexamined Patent Application Publication No. 2004-246204 (FIG. 5 and FIG. 6).

FIG. 16 is a circuit diagram showing a configuration of pixel circuit P0, which is disclosed in the above U.S. Pat. No. 6,229,506. As shown in FIG. 16, a transistor Tr1 is connected between the gate and drain of a driving transistor Tdr. In addition, one electrode L2 of a capacitive element C0 is connected to the gate of the driving transistor Tdr. A holding capacitor C1 is a capacitor that is connected between the gate and source of the driving transistor Tdr. On the other hand, a transistor Tr2 is a switching element, which is connected between a data line 14 and the other electrode L1 of the capacitive element C0 to switch between conduction and non-conduction therebetween. The data line 14 is supplied with an electric potential (hereinafter, referred to as "data electric potential") VD in accordance with a luminance that is specified by an organic light-emitting diode element (hereinafter, referred to as "OLED element") 110.

With the above configuration, firstly, the transistor Tr1 is changed to an on state by signal S2. When the driving transistor Tdr is diode-connected, the electric potential of the gate of the driving transistor Tdr converges on "VEL-Vth" (where Vth is a threshold voltage of the driving transistor Tdr). Secondly, the transistor Tr1 is brought into an off state, and the transistor Tr2 is then brought into an on state by signal S1 to conduct the electrode L1 of the capacitive element C0 with the data line 14. As a result of this process, the electric potential of the gate of the driving transistor Tdr varies by the level which is obtained by dividing the amount of change in the electric potential in the electrode L1 depending on a ratio of the capacitance of the capacitive element C0 to the capacitance of the holding capacitor C1 (that is, the level depending on the data electric potential VD). Thirdly, the transistor Tr2 is brought into an off state, and the transistor Tel is then brought into an on state by signal S3. As a result, a driving current that is not dependent on the threshold voltage Vth is supplied through the driving transistor Tdr and the transistor Tel to the OLED element 110. The configurations, disclosed in Japanese Unexamined Patent Application Publication No. 2004-133240 (FIG. 2 and FIG. 3, and the above Publication No. 2004-246204, basically have the same principle for compensating for the threshold voltage Vth of the driving transistor Tdr.

However, in any one of the above U.S. Pat. No. 6,229,506 and the publication No. 2004-246204, during a period when the OLED element 110 actually emits light (hereinafter referred to as "light emission period"), the transistor Tr2 is changed to an off state, causing the electrode L1 of the capacitive element C0 to enters an electrically floating state. Thus, during the light emission period, the voltage applied to the capacitive element C0 tends to fluctuate. For example, the electric potential of the electrode L1 may fluctuate because of a noise due to switching of the transistor Tr2. As the voltage applied to the capacitive element C0 thus fluctuates during the light emission period, the electric potential of the gate of the driving transistor Tdr and the driving current Iel corresponding to this electric potential fluctuate, thereby causing a variation in the luminance (nonuniform display, such as a crosstalk) of the OLED element 110.

When the capacitances of the capacitive element C0 and/or holding capacitor C1 are increased, it is tentatively possible to reduce the influence of the fluctuation in electric potential of the electrode L1 on the electric potential of the gate of the driving transistor Tdr. However, in this case, because there is a problem that the scale of the pixel circuit P0 increases due to the increase in capacitance, it cannot be a realistic solution under the present circumstances where high-resolution pixels are highly required.

SUMMARY

An advantage of some aspects of the invention is that fluctuation in electric potential of the gate of a driving transistor is suppressed and the wiring arrangement is simplified.

A first aspect of the invention provides an electro-optical device. The electro-optical device includes a plurality of data lines, a plurality of scanning lines, a plurality of unit circuits that are provided in correspondence with intersections of the data lines and the scanning lines. Each of the data lines is supplied with a data voltage in accordance with a gray-scale level. Each of the scanning lines is supplied with a scanning signal that specifies a writing period during which the data voltage is being written into the corresponding unit circuits. Each of the plurality of unit circuits includes a driving transistors an electro-optical element, a capacitive element, a power feed line, a first switching element and a second switching element. The driving transistor generates a driving current in accordance with an electric potential of a gate of the driving transistor. The electro-optical element generates light with a gray-scale level in accordance with the driving current that is generated by the driving transistor. The capacitive element has a first electrode and a second electrode that is connected to the gate of the driving transistor. The power feed line is supplied with a constant electric potential and is, during an initialization period that is different from the writing period, electrically connected to the second electrode. The first switching element conducts the gate of the driving transistor with the drain of the driving transistor at least during the initialization period. The second switching element switches between conduction and non-conduction between the data line and the first electrode on the basis of the scanning signal. The power feed line is arranged in a direction that intersects with the scanning lines.

In this configuration, as the driving transistor is diode-connected through the first switching element, a driving current that is not dependent on a threshold voltage of the driving transistor is generated. In addition, as the second switching element turns on (conduction state), the gate of the driving transistor is set to have an electric potential in accordance with the data voltage.

In a specific embodiment according to an aspect of the invention, the second electrode and the power feed line are electrically connected through a fourth switching element (a transistor Tr4 shown in FIG. 2) during the initialization period. Further, according to the first aspect of the invention, the power feed lines are arranged so as to intersect with the scanning lines. For example, when the scanning lines are arranged in rows, the power feed lines may be arranged in columns.

The "electro-optical element" in the aspects of the invention is an electro-optical element that generates light with a gray-scale level in accordance with an electric current (driving current) supplied thereto (a so-called current drive element) A typical example of this electro-optical element is a light-emitting element (for example, an OLED element) that emits light at a luminance corresponding to a driving current. However, application of the invention is not limited to this. In addition, the power feed lines need not have permanently substantially constant electric potentials. In other words, it is only necessary for the power feed lines to maintain a substantially constant electric potential during a period when a third switching element is at least turned on. During the other period, the electric potentials of the power feed lines may be substantially constant or may fluctuate. Note that, as regard to the electric potential of the power feed line, the "substantially constant" not only includes a state where a strictly constant electric potential is maintained but also includes a state where a substantially constant electric potential, as interpreted in light of the purpose of the aspects of the invention, is maintained. That is, even when the electric potentials of the power feed lines fluctuate in a range between a first electric potential and a second electric potential during a period when the third switching element is turned on, the electric potential that falls within the range between the first electric potential and the second electric potential may be "substantially constant" when a difference between the gray-scale level of the electro-optical element when the electric potential of the power feed line is the first electric potential and the gray-scale level of the electro-optical element when the electric potential of the power feed line is the second electric potential does not cause a problem for actual use of the unit circuit (for example, a difference in gray-scale levels of the electro-optical elements in accordance with the electric potentials of the power feed lines cannot be realized by a user when the electro-optical device is employed as a display device).

In a specific embodiment of the first aspect of the invention, each of the plurality of unit circuits may further include a third switching element that switches between conduction and non-conduction between the power feed line and the first electrode and that conducts the power feed line with the first electrode at least during the initialization period. In this manner, it is possible to diode-connect the transistor through the first switching element and to set the electric potential of the first electrode to an electric potential supplied to the power feed line, prior to setting of the gate electric potential of the transistor to an electric potential corresponding to the threshold voltage of the transistor.

In a specific embodiment of the first aspect of the invention, the third switching element may be turned on when the second switching element is in an off state. With this configuration, the second switching element may set the gate of the driving transistor to an electric potential corresponding to the data electric potential on the basis of the scanning signal. During a period that is different from the writing period, for example, during a period when the driving transistor supplies an electric current corresponding to the data electric potential to the electro-optical element, the first electrode is electrically connected to the power feed line by the third switching element.

A second aspect of the invention provides an electro-optical device. The electro-optical device includes a plurality of data lines, a plurality of scanning lines, a plurality of power feed lines, and a plurality of unit circuits The plurality of unit circuits are provided in correspondence with intersections of the data lines and the scanning lines. Each of the data lines is supplied with a data electric potential corresponding to a gray-scale level. Each of the scanning lines is supplied with a scanning signal that specifies a writing period during which the data electric potential is written into the unit circuit. Each of the power feed line is supplied with a constant electric potential. Each of the plurality of unit circuits includes a driving transistor an electro-optical element, a first switching element, a capacitive element, a second switching element, a third switching element, and a fourth switching element. The driving transistor generates a driving current corresponding to an electric potential of a gate of the driving transistor. The electro-optical element generates light with a gray-scale level corresponding to the driving current that is generated by the driving transistor. The first switching element switches between conduction and non-conduction between the gate and drain of the driving transistor. The capacitive element has a first electrode and a second electrode that is connected to the gate of the driving transistor. The second switching element switches between conduction and non-conduction between the data line and the first electrode on the basis of the scanning signal. The third switching element switches between conduction and non-conduction between the power feed line and the first electrode. The third switching element is turned off when the second switching element is in an on state and is turned on when the second switching element is in an off state. The fourth switching element is connected between the first electrode and the second electrode and switches between conduction and non-conduction between the first electrode and the second electrode. The power feed lines are arranged in directions that intersect with the scanning lines.

In this configuration, as the driving transistor is diode-connected through the first switching element, a driving current that is not dependent on a threshold voltage of the driving transistor is generated. In addition, as the second switching element turns on (conduction state), the gate of the driving transistor is set to an electric potential corresponding to the data electric potential, while, on the other hand, as the second switching element turns off (non-conduction state), the third switching element turns on, so the first electrode of the capacitive element is maintained at a constant electric potential. Thus, it is possible to prevent fluctuation in electric potential of the gate of the driving transistor while avoiding an increase in capacitance provided on the unit circuit.

Furthermore, according to the second aspect of the invention, each of the power feed lines is arranged so as to Intersect with the scanning lines. For example, when the scanning lines are arranged in rows, the power feed lines may be arranged in columns. When the first switching element and the fourth switching element are simultaneously brought into conduction states, threshold compensation of the driving transistor may be executed. The electric current of the diode-connected driving transistor then flows into the power feed line. If the power feed lines are arranged in rows in the same directions as the scanning lines, electric current simultaneously flows into the power feed line from the plurality of unit circuits that are arranged in the same row. For this reason, the width of the power feed line needs to be larger so that it can allow a large electric current to flow therethrough. In contrast, when the power feed line is arranged in a direction that intersects with the scanning lines, the magnitude of electric current that flows thereinto is an amount of a single unit circuit, so that it is possible to reduce the width of the power feed line. Hence, the wiring arrangement may be simplified to achieve high-integration.

A specific embodiment according to the second aspect of the invention may further include a plurality of power supply lines, each of which supplies the driving transistor of each of the plurality of unit circuits with power supply voltage, wherein the power supply lines intersect with the power feed lines at intersections, and a holding capacitor that is formed at each of the intersections. In this case, it is possible to further stabilize the electric potential of the power feed line by the holding capacitor.

In a specific embodiment according to the second aspect of the invention, in each of the plurality of unit circuits, the second switching element and the third switching element may be transistors of different conductivity types, and a common scanning signal may be supplied to the gate of the second switching element and the gate of the third switching element. According to this aspect, because a wiring for controlling the second switching element and a wiring for controlling the third switching element may be shared, it is possible to simplify the wiring arrangement.

The electro-optical device according to the aspects of the invention may be used for various electronic apparatuses. A typical example of this electronic apparatus is an apparatus that employs the electro-optical device as a display device. The electronic apparatus of this type includes a personal computer, a portable telephone, and the like. However, applications of the electro-optical device are not limited to image display. For example, in an image forming apparatus (printer) in which a latent image is formed on an image support body, such as a photoreceptor drum, by means of irradiation of light ray, the electro-optical device according to the aspects of the invention may be employed as a device that exposes the image support body (a so-called exposure head).

BRIEF DESCRIPTION OF THE DRAWINGS

The invention will be described with reference to the accompanying drawings, wherein like numbers reference like elements.

FIG. 5 is a circuit diagram for illustrating the operation of the pixel circuit during a reset period.

FIG. 6 is a circuit diagram for illustrating the operation of the pixel circuit during a compensation period.

FIG. 7 is a circuit diagram for illustrating the operation of the pixel circuit during a writing period.

FIG. 8 is a circuit diagram for illustrating the operation of the pixel circuit during a light emission period.

DESCRIPTION OF EXEMPLARY EMBODIMENTS

Configuration of Electro Optical Device

Figure 1:
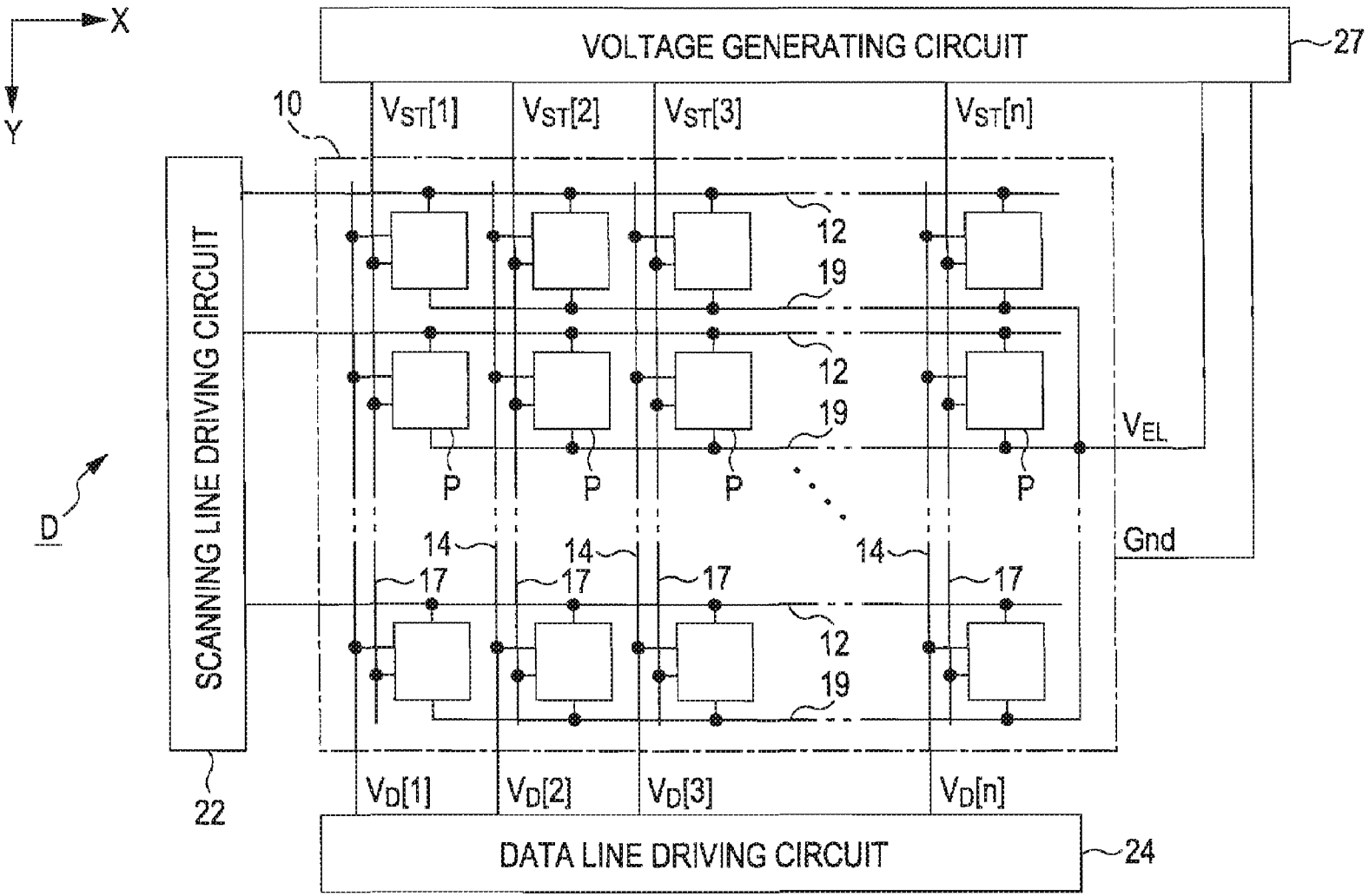
FIG. 1 is a block diagram showing a configuration of an electro-optical device according to an embodiment of the invention.

FIG. 1 is a block diagram showing a configuration of an electro-optical device according to an embodiment of the invention. The electro-optical device D is a device, used for various electronic apparatuses, that displays an image. The electro-optical device D includes a pixel array portion 10, a scanning line driving circuit 22, a data line driving circuit 24, and a voltage generating circuit 27. The pixel array portion 10 has a plurality of pixel circuits P that are arranged thereon in a planar manner. The scanning line driving circuit 22 and the data line driving circuit 24 drive pixel circuits P (unit circuits) The voltage generating circuit 27 generates a voltage used in the electro-optical device D. Note that the scanning line driving circuit 22, the data line driving circuit 24 and the voltage generating circuit 27 are illustrated as individual circuits in FIG. 1, but a configuration in which part or all of these circuits are combined as a single circuit may be employed. In addition, the single scanning line driving circuit 22 (or the data line driving circuit 24, or the voltage generating circuit 27) shorten in FIG. 1 may be implemented on the electro-optical device D in the form that the single circuit is partitioned into a plurality of IC chips.

As shown in FIG. 1, the pixel array portion 10 has m control lines 12 extending in an X direction, n data lines 14 extending in a Y direction that is perpendicular to the X direction, n power feed lines 17 provided in pairs with the corresponding data lines 14, extending in the Y direction ("m" and "n" are natural numbers). Each pixel circuit P is disposed at a position corresponding to the intersection of the pair of data line 14 and power feed line 1, and the corresponding control line 12. Thus, these pixel circuits P are arranged in a matrix of m rows by n columns. Further, m power supply lines 19 are formed in the X direction, The scanning line driving circuit 22 is a circuit that selects the plurality of pixel circuits P in units of rows during every horizontal scanning period. On the other hand, the data line driving circuit 24 generates data electric potentials VD[1] to VD[n] corresponding to the pixel circuits P for a single row (n number) that are selected by the scanning line driving circuit 22 during each horizontal scanning period and outputs the data electric potentials VD[1] to VD[n] to the data lines 14. The data electric potential VPD[j], which is output to the data line 14 in the j-th column ("j" is an integer that satisfies $1 \leqq j \leqq n$) during a horizontal scanning period when the i-th row ("i" is an integer that satisfies $1 \leqq i \leqq m$) is selected, attains an electric potential corresponding to a gray-scale level specified for the pixel circuit P that is positioned at the i-th row and the j-th column.

The voltage generating circuit 27 generates a high-level side electric potential VEL of a power supply (hereinafter, referred to as "power supply electric potential") and a low-level side electric potential Gnd of the power supply (hereinafter, referred to as "ground electric potential"). The power supply electric potential VEL is supplied through the power supply lines 19 to the pixel circuits P. In addition, the voltage generating circuit 27 generates n electric potentials VST[j]. The electric potentials VST[j] are output to the corresponding power feed lines 17 and then supplied to the corresponding pixel circuits P.

The configuration of the pixel circuits P will now be described with reference to FIG. 2. Although FIG. 2 only shows a single pixel circuit P that is positioned at the i-th row and the j-th column, the other pixel circuits P each have the same configuration.

As shown in, the drawing, the pixel circuit P includes an electro-optical element 11 that is connected between a power supply line to which the power supply electric potential VEL is supplied and a ground line to which the ground electric potential Gnd is supplied. The electro-optical element 11 is a current driving type light-emitting element that emits light with a luminance corresponding to a driving current Iel supplied thereto. A typical example of the electro-optical element 11 is an OLED element that has a luminous layer made of organic EL material interposed between the anode and the cathode.

Figure 2:
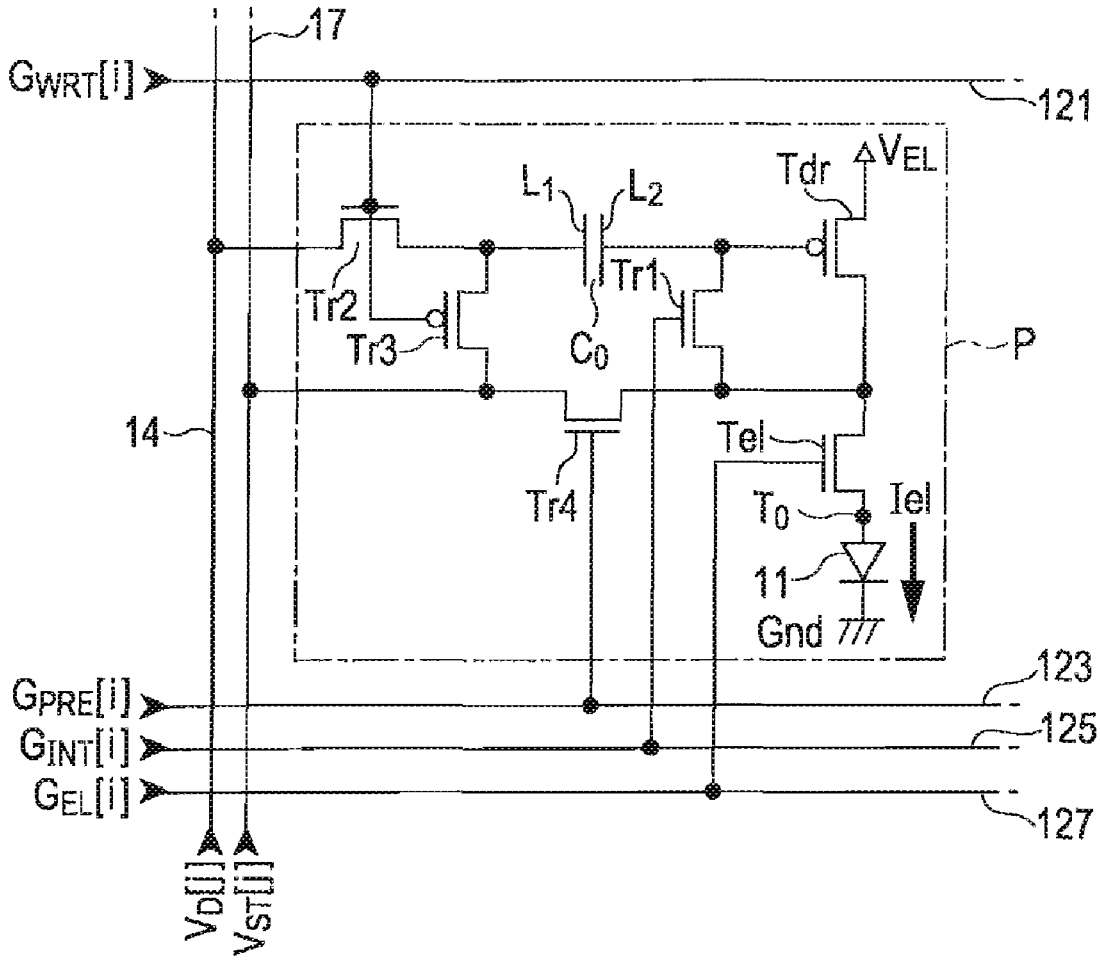
FIG. 2 is a circuit diagram showing a configuration of a pixel circuit.

As shown in FIG. 2, the control line 12, which is shown in FIG. 1 as a single wiring line for descriptive purposes, actually includes four wiring lines (a scanning line 121, a first control line 123, a second control line 125, and a light emission control line 127). Each of the wiring lines is supplied with a predetermined signal from the scanning line driving circuit 22. For example, the i-th row scanning line 121 is supplied with a scanning signal GWRT[i] for selecting the pixel circuits P in the same row. In addition, the first control line 123 is supplied with a reset signal GPRE[i], and the second control line 125 is supplied with an initialization signal GINT[i]. Furthermore, the light emission control line 127 is supplied with a light emission control signal GEL[i] that specifies a period (light emission period, which will be described later) during which the electro-optical element 11 actually emits light. Note that a specific waveform of each signal and the operation of the pixel circuit P in accordance with the waveform will be described later.

As shown in FIG. 2 a p-channel driving transistor Tdr and an n-channel light emission control transistor Tel are connected in a path from the power supply line to the anode of the electro-optical element 11. The driving transistor Tdr is a device that generates a driving current Iel corresponding to an electric potential VG of the gate thereof. The source of the driving transistor Tdr is connected to the power supply line, and the drain of the driving transistor Tdr is connected to the drain of the light emission control transistor Tel. The light emission control transistor Tel is a device that specifies a period during which the driving current Iel is actually supplied to the electro-optical element 11. The source of the light emission control transistor Tel is connected to the anode of the electro-optical element 11, and the gate of the light emission control transistor Tel is connected to the light emission control line 127. Thus, during a period when the light emission control signal. GEL[i] maintains a low level, the light emission control transistor Tel is turned off so as to interrupt the supply of driving current Iel to the electro-optical element 11. On the other hand, when the light emission control signal GEL[i] is changed to a high level, the light emission control transistor Tel is turned on so as to supply the electro-optical element 11 with the driving current Iel. Note that the light emission control transistor Tel may be connected between the driving transistor Tdr and the power supply line.

An n-channel transistor Tr1 is connected between the gate and drain of the driving transistor Tdr. The gate of the transistor Tr1 is connected to the second control line 125. Thus, as the initialization signal GINT[i] is changed to a high level, the transistor Tr1 turns on and the driving transistor Tdr is diode-connected. As the initialization signal GINT[i] is changed to a low level, the transistor Tr1 turns off and the diode connection of the driving transistor Tdr is released.

A capacitive element C0 shown in FIG. 2 is a capacitor that holds a voltage applied between a first electrode L1 and a second electrode L2. The second electrode L2 is connected to the gate of the driving transistor Tdr. An n-channel transistor Tr2 is connected between the first electrode L1 of the capacitive element C0 and the data line 14. A p-channel (that is, a different conductivity type) transistor Tr3 is connected between the first electrode L1 and the power feed line 17. The transistor Tr2 is a switching element that switches between conduction and non-conduction between the first electrode L1 and the data line 14. The transistor Tr3 is a switching element that switches between conduction and non-conduction between the first electrode L1 and the power feed line 17. The gate of the transistor Tr2 and the gate of the transistor Tr3 are connected to the common scanning line 121. Thus, the transistor Tr2 and the transistor Tr3 work in a complimentary manner. That is, when the scanning signal GWRT[i] is a high level, the transistor Tr2 is turned on and the transistor Tr3 is turned off. In contrast, when the scanning signal GWRT[i] is a low level, the transistor Tr2 is turned off and the transistor Tr3 is turned on.

An n-channel transistor Tr4 shown in FIG. 2 is a switching element that is connected between the first electrode L1 and second electrode L2 of the capacitive element C0 and switches between conduction and non-conduction therebetween. Specifically in detail, the transistor Tr4 is connected at one end to the first electrode L1 through the transistor Tr3 and connected at the other end to the second electrode L2 through the transistor Tr1. The gate of the transistor Tr4 is connected to the first control line 123. Thus, during a period when the transistor Tr1 and the transistor Tr3 each maintain an on state, as the reset signal GPRE[i] is changed to a high level, the transistor Tr4 is turned on so as to short-circuit the first electrode L1 and the second electrode L2.

Structure of Electro Optical Device

Figure 3:
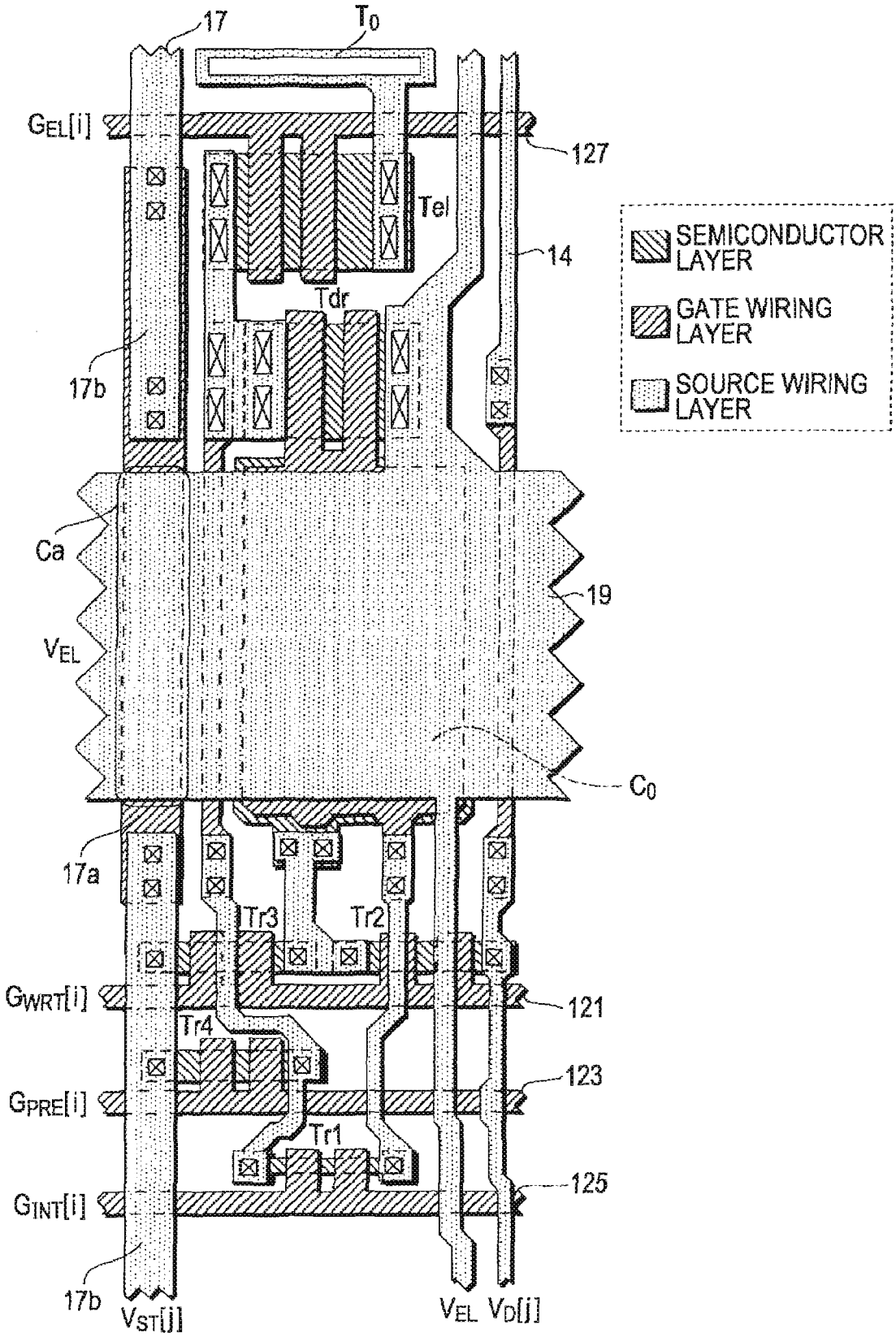
FIG. 3 is a plan view schematically showing a configuration of a relevant part of the electro-optical device.

FIG. 3 is a plan view schematically showing a structure of a pixel of the electro-optical device. Although FIG. 3 only shows a semiconductor layer, a gate wiring layer and a source wiring layer, these layers are, for example, formed on a substrate made of glass, or the like, and layers such as an insulating layer, and the like, are interposed between these wiring layers. However, such layers are omitted for descriptive purposes. In addition, an insulating layer is formed or the wiring layers, and the electro-optical element 11 is formed on the insulating layer and connected to the source wiring layer through a terminal T0. Furthermore, a ground electrode is formed on the electro-optical element 11. However, these are not shown in the drawing. An insulating layer is provided between the gate wiring layer and the semiconductor layer. The capacitive element C0 is formed between the electrode (L1) provided on the semiconductor layer and the electrode (L2) provided on the gate wiring layer.

The power feed line 17 to which a voltage VST[j] is supplied is disposed vertically so as to intersect with the four lines forming the control line 12 (the scanning line 121, the first control line 123, the second control line 125, and the light emission control line 127). The power feed line 17 includes a wiring line 17*a* of the gate wiring layer and a wiring line 17*b* of the source wiring layer that is connected to the wiring line 17*a* of the gate wiring layer through a contact hole. Further, the power supply line 19 intersects with the wiring line 17*a* of the power feed line 17 at an intersection where a holding capacitor Ca is formed. The holding capacitor Ca is a capacitor that accompanies the power feed line 17 and functions to stabilize the voltage VST[j].

Behavior of Electro Optical Device

Figure 4:
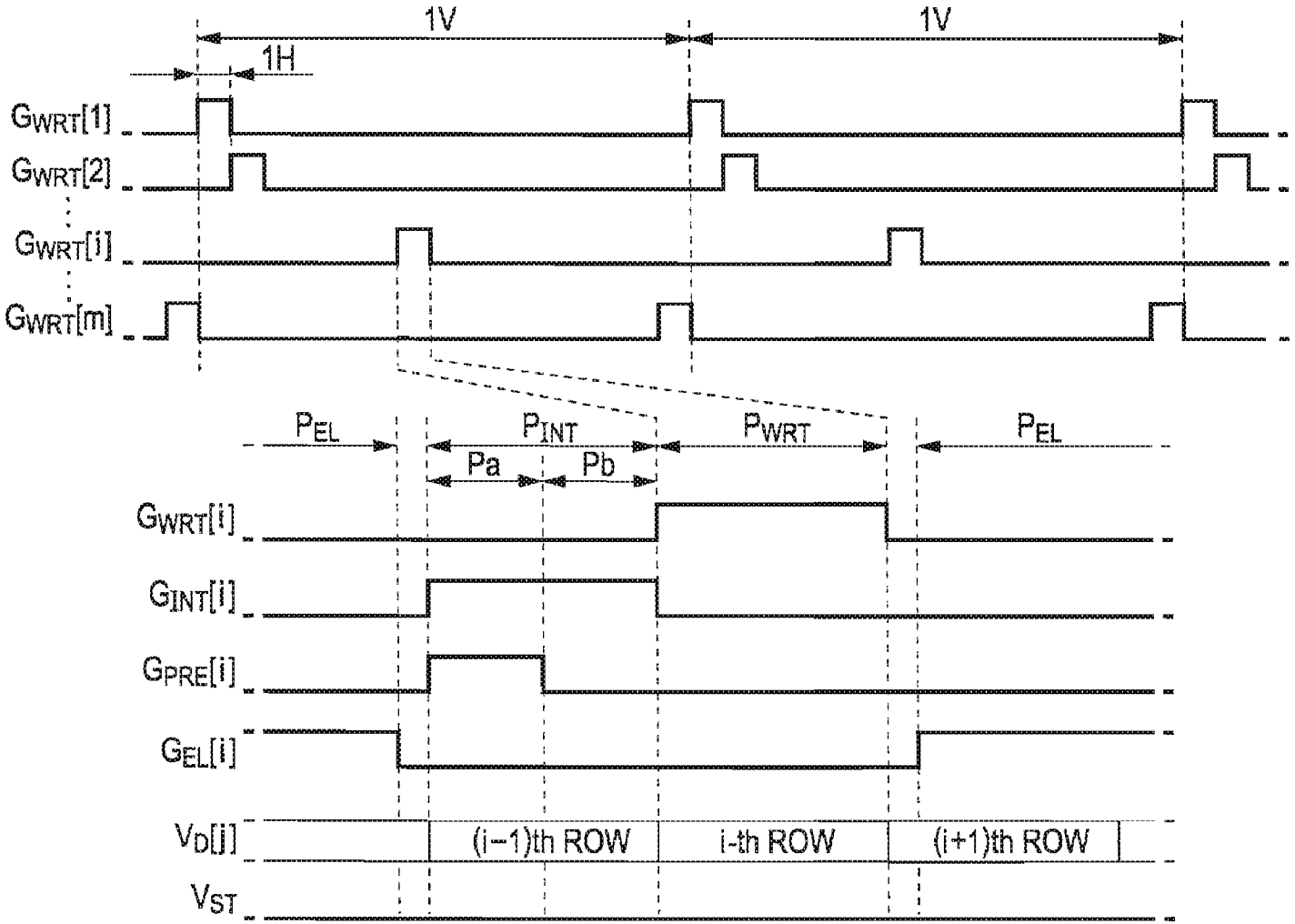
FIG. 4 is a timing chart showing a waveform of each signal.

Specific waveforms of the signals that the scanning line driving circuit 22 generates will now be described with reference to FIG. 4. As shown in FIG. 4, the scanning signals GWRT[1] to GWRT[m] are sequentially changed to a high level during every horizontal scanning period (1H). That is, the scanning signal GWRT[i] maintains a high level during the i-th horizontal scanning period within a vertical scanning period (1V), while, on the other hand, it maintains a low level during the other period within the vertical scanning period (1V). Changing the scanning signal GWRT[i] to a high level means selection of the pixel circuits P in the i-th row. Hereinafter, periods during which the scanning signals GWRT[1] to GWRT[m] each attain a high level (that is, a horizontal scanning period) are indicated as "writing periods PWRT". Note that, though FIG. 4 illustrates a case where the trailing edge of the scanning signal GWRT[i] and the leading edge of the scanning signal GWRT[i+1] for the next row are set at the same time, a configuration in which the leading edge of the scanning signal GWRT[i+1] is set at a predetermined interval from the trailing edge of the scanning signal GWRT[i] (that is, a configuration in which an interval is provided for each writing period PWRT) may be employed.

The initialization signal GINT[i] is a signal that maintains a high level during a period (hereinafter, referred to as an "initialization period") PINT immediately before the writing period PWRT during which the scanning signal GWRT[i] attains a high level and that maintains a low level during the other period. As shown in FIG. 4, the initialization period PINT is divided into a reset period Pa and a compensation period Pb that comes immediately after the reset period. The reset period Pa is a period during which electric charge that remains in the capacitive element C0 at the initial point thereof is discharged (reset). The compensation period Pb is a period during which the electric potential VG of the gate of the driving transistor Tdr is set to an electric potential corresponding to the threshold voltage Vth. The reset signal GPRE[i] is a signal that attains a high level during the reset period Pa of the initialization period PINT when the initialization signal GINT[i] attains a high level and that maintains a low level during the other period.

The light emission control signal GEL[i] is a signal that attains a high level during a period (hereinafter, referred to as a "light emission period") PEL from the time when the writing period PWRT during which the scanning signal GWRT[i] attains a high level has elapsed until the time when the initialization period PINT during which the initialization signal GINT[i] attains a high level is initiated, and that attains a low level during the other period (that is, the period Including the initialization period PINT and the writing period PWRT).

A specific operation of the pixel circuit P will now be described with reference to FIGS. 5 to 8. Hereinafter, the operation of the pixel circuit P in the j-th column belonging to the i-th row will be described separately for the reset period Pa, the compensation period Pb, the writing period PWRT, and the light emission period PEL.

(a) Reset Period Pa (Initialization Period PINT)

During the reset period Pa, as shown in FIG. 4, the initialization signal GINT[i] and the reset signal GPRE[i] each maintain a high level, while the scanning signal GWRT[i] and the light emission control signal GEL[i] each maintain a low level. Thus, as shown in FIG. 5, the transistors Tr1, Tr3, Tr4 each are changed to an on state, and the transistor Tr2 and the light emission control transistor Tel each maintain an off state. In this state, the first electrode L1 and second electrode L2 of the capacitive element C0 are conducted with each other through the transistors Tr3, Tr4, Tr1, so that the electric charge stored in the capacitive element C0 at the time immediately before the initiation of the reset period Pa is completely removed. Owing to this reset of charge stored in the capacitive element C0, regardless of a state of the capacitive element C0 (residual electric charge in the capacitive element C0) at the time of initiation of the reset period Pa, it is possible to accurately set the electric potential VG of the gate of the driving transistor Tdr to a desired value during the following compensation period Pb and the following writing period PWR. In addition, because the gate of the driving transistor Tdr is conducted with the power feed line 17 through the transistors Tr1, Tr4 during the reset period Pa, the electric potential V0 of this gate is substantially equal to the electric potential VST[i] that is generated by the voltage generating circuit 27. Note that during a normal operation, the electric potentials VST[j] are the same, so each of them is simply referred to as an electric potential VST, hereinafter. The electric potential VST in the present embodiment is set at a level that is equal to or lower than a differential value (VEL−Vth) between the power supply electric potential VEL and the threshold voltage of the driving transistor Tdr. The driving transistor Tdr in the present embodiment is of the p-channel type, so that the driving transistor Tdr is turned on when the electric potential VST is supplied to the gate thereof. That is, the electric potential VST may also be regarded as an electric potential that turns on the driving transistor Tdr when the electric potential VST is supplied to the gate of the driving transistor Tdr.

Figure 10:
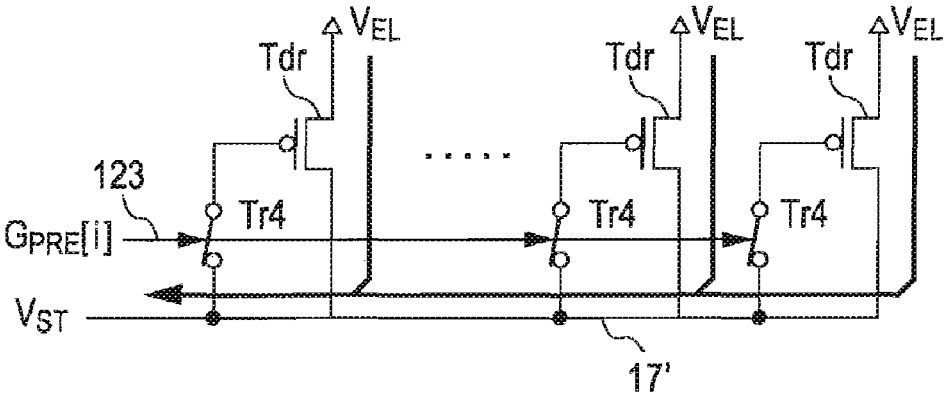
FIG. 10 is a circuit diagram for schematically illustrating the operation of an existing pixel circuit during a reset period.

During the reset period Pa, reset operation is performed for all the pixel circuits P in the i-th row. Then, electric current flows into the power feed lines 17. If a power feed line 17' is provided parallel to the control line 12, such as the scanning line 121 or the first control line 123, reset electric current flows from all the pixel circuits P belonging to the same one row to the power feed line 17', for example, as shown in FIG. 10. For this reason, from the viewpoint of prevention of burnout and/or voltage drop, the width of the wiring line of the power feed line 17' needs to be sufficiently increased, so that there is still room for improvement from the viewpoint of high integration. In response, in the present embodiment, as shown in FIG. 3, because the power feed line 17 is disposed perpendicular to the control line 12 (the scanning line 121, the first control line 123, the second control line 125, and the light emission control line 127), only the reset electric current from the single pixel circuit P flows into the power feed line 17 during the reset operation. Thus, the width of the power feed line 17 need not be increased more than necessary, and it is possible to achieve high integration.

(b) Compensation Period Pb (Initialization Period PINT)

During the compensation period Pb, as shown in FIG. 4, the reset signal GPRE[i] is changed to a low level, while, on the other hand, the other signals maintain the same levels as those during the reset period Pa. In this state, the transistor Tr4 changes from a state shown in FIG. 5 to an off state, as shown in FIG. 6. Thus, the electric potential of the second electrode L2 (that is, the electric potential VG of the gate of the driving transistor Tdr) is increased from the electric potential VST that is set during the reset period Pa to a differential value (VEL−Vth) between the power supply electric potential VEL and the threshold voltage Vth, while the electric potential of the first electrode L1 that is connected to the power feed line 17 through the transistor Tr3 remains at the electric potential VST.

(c) Writing Period PWRT

During the writing period PWRT, as shown in FIG. 4, the scanning signal GWRT[i] is changed to a high level, and the initialization signal GINT[i], the reset signal GPRE[i] and the light emission control signal GEL[i] each maintain a low level. Thus, as shown in FIG. 7, the transistors Tr1, Tr3, Tr4 and the light emission control transistor Tel each maintain an off state, while, on the other hand, the transistor Tr2 is changed to an on state so as to conduct current through the data line 14 with the first electrode L1. Thus, the electric potential, of the first electrode L1 changes from the electric potential VST, which is supplied during the compensation period Pb, to the data electric potential VD[j] corresponding to a gray-scale level of the electro-optical element 11.

As shown in FIG. 7, during the writing period PWRT the transistor Tr1 is in an off state, and the gate of the driving transistor Tdr has sufficiently high impedance. Thus, as the first electrode L1 changes from the electric potential VST during the compensation period Pb to the data electric potential VD[j] by the amount of change ΔV(=VST−VD[j]), the electric potential of the second electrode L2 (the electric potential VG of the gate of the driving transistor Tdr) changes from the preceding electric potential (VEL−Vth) due to capacity coupling. The amount of change in electric potential of the second electrode L2 then is determined in accordance with a capacity ratio of the capacitive element C0 to the other parasitic capacities (for example the capacity of the gate of the driving transistor Tdr and capacities that parasitize the other wirings). More specifically, where the capacitance of the capacitive element C0 is "C" and the capacitance of the parasitic capacity is "Cs", the amount of change in electric potential of the second electrode L2 is expressed as "ΔV·C/(C+Cs)". Thus, during the writing period PWRT, the electric potential VG of the gate of the driving transistor Tdr becomes stable at a level expressed by the following equation (1).

$$VG=VEL-Vth-k\cdot\Delta V \quad (1)$$

where k=C/(C+Cs)

(d) Light Emission Period PEL

During the light emission period PEL, as shown in FIG. 4, the initialization signal GINT[i] and the reset signal GPRE[i] each maintain a low level, so that the transistors Tr1, Tr4 each maintain an off state. In addition, because the scanning signal GWRT[i] maintains a low level during the light emission period PEL, the transistor Tr2 is changed to an off state and the transistor Tr3 is changed to an on state, as shown in FIG. 8. Thus, the first electrode L1 of the capacitive element C0 is electrically insulated from the data line 14 by the transistor Tr2 that is in an off state, and, at the same time, is connected to the power feed line 17 through the transistor Tr3 that is in an on state. As a result, during the light emission period PEL, the electric potential of the first electrode L1 is fixed at the electric potential VST, and thereby the electric potential VG of the gate of the driving transistor Tdr (the electric potential of the second electrode L2) is maintained at a substantially constant. In other words, the capacitive element C0 in the present embodiment functions as a coupling capacitor that sets the gate of the driving transistor Tdr to a desired electric potential (an electric potential expressed by the equation (1)) during the writing period PWRT when the first electrode L1 is connected to the data line 14 and also functions as a holding capacitor that maintains the gate of the driving transistor Tdr a constant electric potential during the light emission period PEL when the first electrode L1 is connected to the power feed line 17.

In addition, during the light emission period PEL, the light emission control signal GEL[i] maintains a high level, so that the light emission control transistor Tel is turned on so as to form a path of the driving current Iel, as shown in FIG. 8. Thus, the driving current Iel corresponding to the electric potential VG of the gate of the driving transistor Tdr is supplied from the power supply line to the electro-optical element 11 through the driving transistor Tdr and the light emission control transistor Tel. The supply of driving current Iel allows the electro-optical element 11 to emit light with a luminance corresponding to the data electric potential VD[j].

Now assuming a state where the driving transistor Tdr operates in a saturation region, the driving current Iel is expressed by equation (2) as follows. Where "β" is a coefficient of gain of the driving transistor Tdr, and "Vgs" is a voltage applied between the gate and source of the driving transistor Tdr, $$Iel=(\beta/2)(Vgs-Vth)2=(\beta/2)(VG-VEL-Vth)2 \quad (2)$$

When equation (1) is substituted for VG in equation (2), the following equation is obtained.

$$Iel=(\beta/2)\{(VEL-Vth-k\cdot\Delta V)-VEL-Vth\}2=(\beta/2)(k\cdot\Delta V)2$$

That is, the driving current Iel supplied to the electro-optical element 11 is determined only by a differential value ΔV(=VST−VD[j]) between the data electric potential VD[j] and the electric potential VST and is not dependent on the threshold voltage Vth of the driving transistor Tdr. Thus, a variation in luminance due to variation in threshold values Vth among the pixel circuits P is suppressed.

Figure 16:
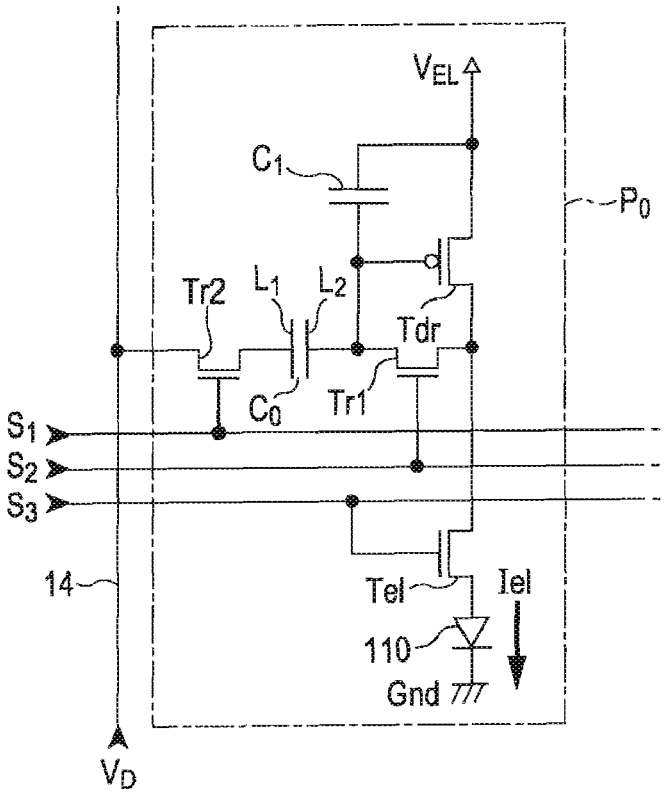
FIG. 16 is a circuit diagram showing a configuration of an existing pixel circuit.

In a pixel circuit P0 shown in FIG. 16, an electrode L1 of the capacitive element C0 enters a floating state during the light emission period PEL, so that the electric potential of the electrode L1 tends to fluctuate. In contrast to this, in the present embodiment, the first electrode L1 of the capacitive element C0 is maintained at the electric potential VST during the light emission period PEL, so that the electric potential VG of the gate of the driving transistor Tdr is maintained at a substantially constant over the entire light emission period PEL. Thus, it is possible to allow the electro-optical element 11 to emit light with a desired luminance accurately by preventing fluctuation of the driving current Iel. In other words, even when a sufficient capacitance is not ensured for the capacitive element C0, it is possible to keep the electric potential VG of the gate of the driving transistor Tdr substantially constant. Hence, it is possible to reduce the capacitance of the capacitive element C0 in comparison with the configuration shown in FIG. 16, in which the capacitive element C0 with a sufficient capacitance is required for maintaining the electric potential VG. In addition, in the configuration shown in FIG. 16, an additional capacitive element, in addition to the capacitive element C0, is required for ensuring the electric potential VG. On the other hand, in the present embodiment, because the electric potential VG of the gate may be maintained with a capacitive element having a small capacity, as shown in FIG. 2, it is possible to omit a holding capacitor C1 shown in FIG. 16. As described above, because a capacitance required for the pixel circuit P is reduced, the present embodiment is advantageous in that the scale of the pixel circuit P is reduced.

Behavior in Characteristics Test

Figure 9:
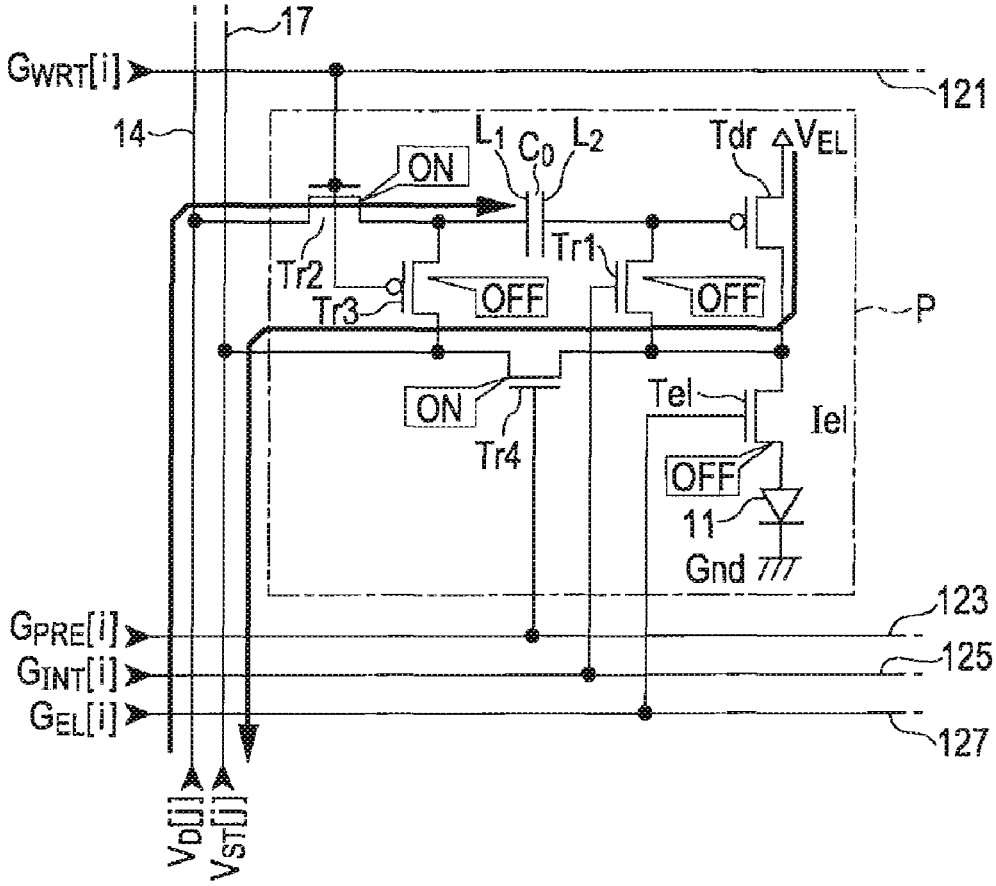
FIG. 9 is a circuit diagram for illustrating the operation of the pixel circuit during a measurement period.

In the above configured electro-optical device, a predetermined scanning signal GWRT[i] is brought to a high level to select the electro-optical element 11 in the i-th row, and the operation is then performed from the reset period Pa shown in FIG. 5 to the writing period PWRT shown in FIG. 7 to write a test data electric potential VD[j]. After that, as shown in FIG. 9, for example, the initialization signal GINT[i] is brought to a low level during a predetermined period (a measurement period PT) to turn off the transistor Tr1, and the reset signal GPRE[i] is brought to a high level to turn on the transistor Tr4, and, furthermore, the scanning signal GWRT [i] is brought to a high level to turn on the transistor Tr2 and to turn off the transistor Tr3. In this manner, it is possible to test the individual driving transistors Tdr.

In such a state, electric current corresponding to the electric potential of the gate of the driving transistor Tdr is output to the power feed line 17. In this characteristics test, the electric potentials of the data lines 14 are separately controlled. In this manner, it is possible to set the voltage Vgs between the gate and source of the driving transistor Tdr. Then, when electric current flowing from the driving transistor Tdr is measured, it is possible to test the characteristics of the driving transistor Tdr. If the power feed line 17 is arranged in the same direction as the scanning line 121 as shown in FIG. 10, electric current flows from all the pixel circuits P belonging to the same one row to the power feed line 17', so that it is impossible to separately test the characteristics of the driving transistors Tdr. In contrast to this, in the present embodiment, because the power feed line 17 is arranged in a direction that intersects with the scanning line 121, it is possible to easily determine the quality of the individual driving transistors Tdr in accordance with electric current flowing in the individual driving transistors Tdr.

Alternative Embodiments

The above described embodiments may be modified into various alternative embodiments. Specific alternative embodiments will be described, for example, as follows. Note that the following embodiments may be combined where appropriate.

(1) First Alternative Embodiment

Figure 11:
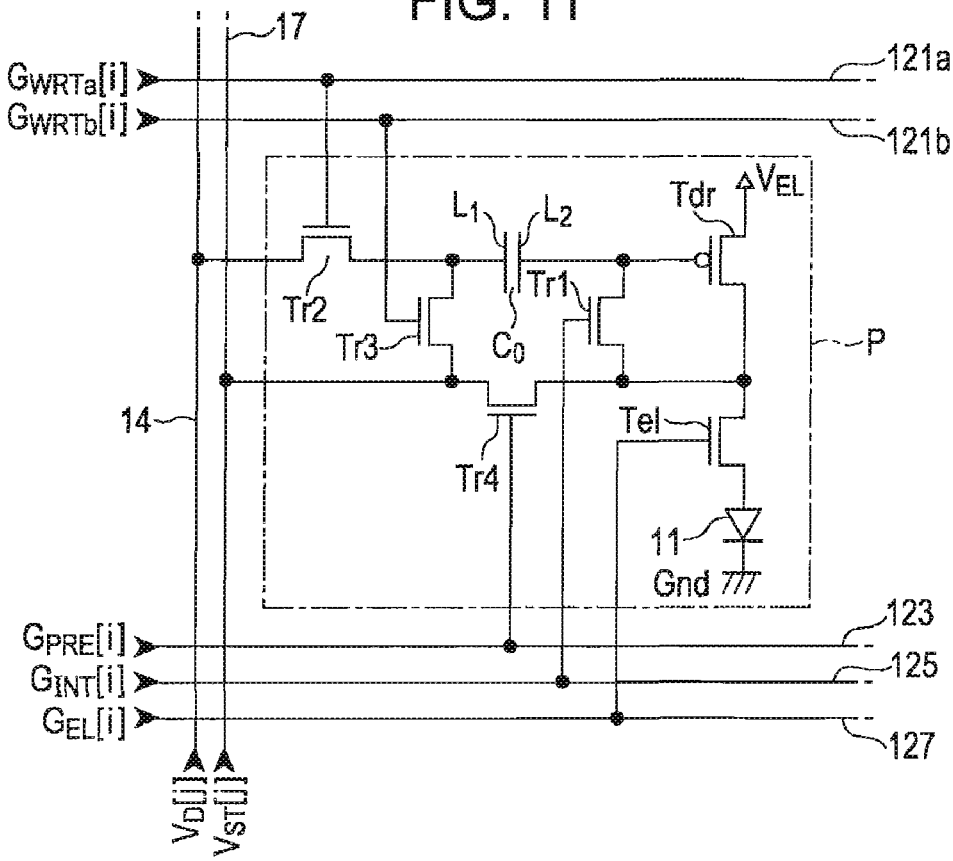
FIG. 11 is a circuit diagram showing a configuration of a pixel circuit according to an alternative embodiment of the invention.

In the above described embodiments, the configuration in which the transistor Tr2 and the transistor Tr3 are transistors of different conductivity types is illustrated; however, the configuration for activating the transistor Tr2 and the transistor Tr3 in a complimentary manner is not limited to it. For example, as shown in FIG. 11, the transistor Tr2 and the transistor Tr3 may be transistors of the same conductive types (n-channel type) with respect to each other. With this configuration, the gate of the transistor Tr2 is connected to a first scanning line 121*a*, and the gate of the transistor Tr3 is connected to a second scanning line 121*b*. Then, the first scanning line 121*a* is supplied with a first scanning signal GWRT [i] having the same waveform as the scanning signal GWRT [i] shouts on FIG. 4, and the second scanning line 121*b* is supplied with a second scanning signal GWRTb[i] having the inverted logic level with respect to the first scanning signal GWRTa[i]. With this configuration as well, the operations shown in FIGS. 5 to 8 may be performed. However, when the transistor Tr2 and he transistor Tr3 are transistors of different conductivity types, as shown in FIG. 2, these transistors may be controlled through the common scanning line 121, so that it is advantageous in that the configuration is simplified as compared to the embodiment show in FIG. 11.

(2) Second Alternative Embodiment

Figure 12:
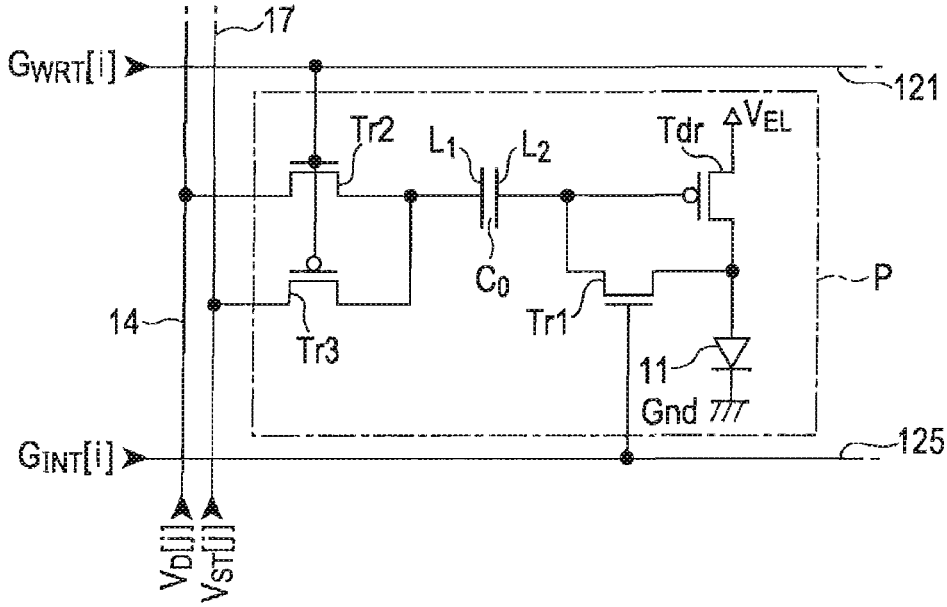
FIG. 12 is a circuit diagram showing a configuration of a pixel circuit according to an alternative embodiment of the invention.

The transistor Tr4 and/or the light emission control transistor Tel are omitted where appropriate. FIG. 12 is a circuit diagram snowing a configuration of the pixel circuit P in which the transistor Tr4 and the light emission control transistor Tel shown in FIG. 2 are omitted. With this configuration, during the initialization period PINT, the scanning signal GWRT[i] attains a low level, and the initialization signal GINT[i] attains a high level. Thus, the first electrode L1 is maintained at the electric potential VST by turning on the transistor Tr3, the gate of the driving transistor Tdr that is diode-connected through the transistor Tr1 converges on the electric potential VG(=VEL−Vth) corresponding to the threshold voltage Vth.

During the subsequent writing period PWRT, the initialization signal GINT[i], which is in a low level, turns off the transistor Tr1. Furthermore, as the scanning signal GWRT[i] is changed to a high level, the transistor Tr2 turns on. Hence, the gate of the driving transistor Tdr is set to the electric potential VG (equation (1)) corresponding to the data electric potential VD[i] on the basis of the same principle as in the case of the above embodiment.

Moreover, during the light emission period PEL, both the scanning signal GWRT[i] and the initialization signal GINT [i] maintain a low level. The transistor Tr3 is brought to an on state by the scanning signal GWRT[i] that is in a low level, so that the electric potential of the first electrode L1 is fixed at the electric potential VST. Thus, fluctuation in electric potential VG of the gate of the driving transistor Tdr is prevented. As described above, the configuration shown in FIG. 12 also avoids a floating state of the first electrode L1, so that it is possible to suppress an enlarged scale of the pixel circuit P and to suppress fluctuation in electric potential of the gate of the driving transistor Tdr.

(3) Third Alternative Embodiment

Conductive types of the transistors that form the pixel circuit P may be changed where appropriate. For example, the driving transistor Tdr shown in FIG. 2 may be of an n-channel type. In this case, the electric potential VST supplied to the power feed line 17 is set to an electric potential that turns on the driving transistor Tdr when the gate of the driving transistor Tdr is supplied with the electric potential VST. Note that, when the driving transistor Tdr is of an n-channel type, the transistor Td1 is connected between the gate of the driving transistor Tdr and the power supply line (electric potential VEL). In addition, the OLED element is just one of examples of the electro-optical element 11. For example, in place of the OLED element, various light-emitting elements, such as an inorganic EL element or an LED (Light Emitting Diode) element, may be employed as an electro-optical element according to the aspects of the invention. The electro-optical element according to the aspects of the invention may be any elements that change a gray-scale level (typically, a luminance) in accordance with the supply of electric current, and a specific structure is not required.

Applications

Figure 13:
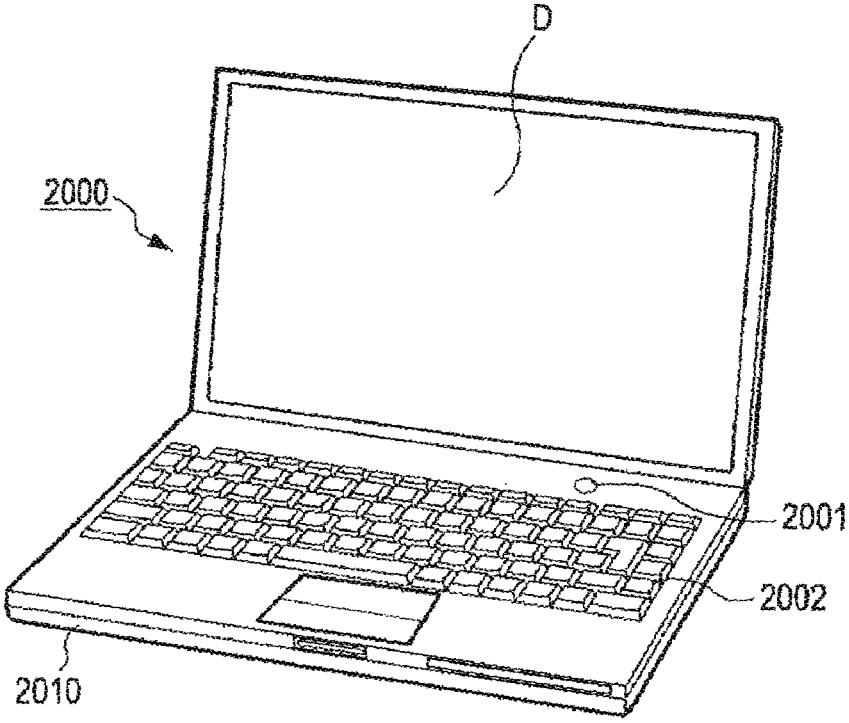
FIG. 13 is a perspective view showing a specific embodiment of electronic apparatus according to the invention.

Electronic apparatuses that employ the electro-optical device D according to the aspects of the invention will now be described. FIG. 13 is a perspective view showing a configuration of a mobile personal computer that employs the electro-optical device D according to any one of the embodiments described above as a display device. The personal computer 2000 includes the electro-optical device D, which serves as a display device, and a main body portion 2010. The main body portion 2010 is provided with a power switch 2001 and a keyboard 2002. This electro-optical device D uses an OLED element for the electro-optical element 11, so that it is possible to display a screen that has a wide viewing angle and that is easily viewable.

Figure 14:
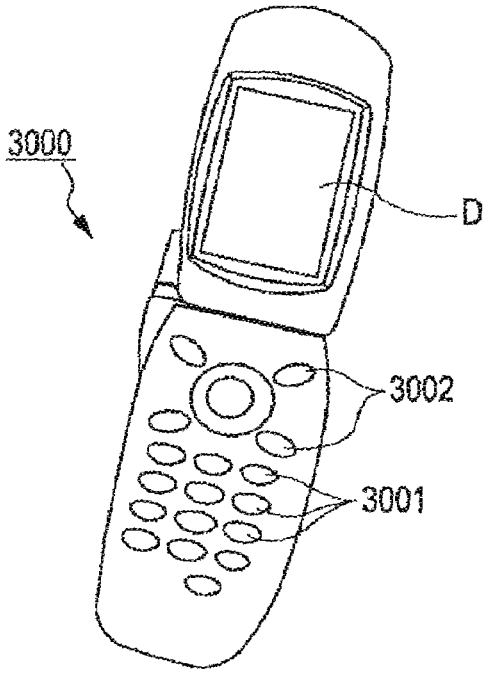
FIG. 14 is a perspective view showing a specific embodiment of electronic apparatus according to the invention.

FIG. 14 shows a configuration of a portable telephone that employs the electro-optical device D according to the above described embodiments. The portable telephone 3000 includes a plurality of operation buttons 3001, a plurality of scroll buttons 3002, and the electro-optical device D, which serves as a display device. By manipulating the scroll buttons 3002, an image displayed on the electro-optical device D is scrolled.

Figure 15:
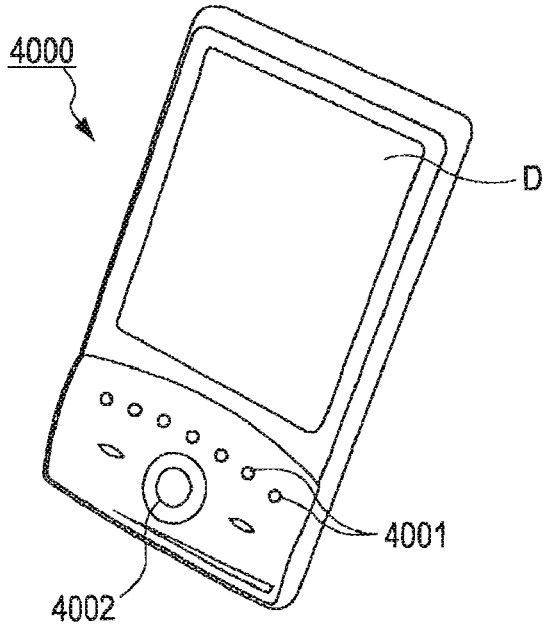
FIG. 15 is a perspective view showing a specific embodiment of electronic apparatus according to the invention.

FIG. 15 shows a configuration of a portable information terminal (PDA: Personal Digital Assistants) that employs the electro-optical device D according to the above described embodiments. The portable information terminal 4000 includes a plurality of operation buttons 4001, a power switch 4002, and the electro-optical device D, which serves as a display device. As the power switch 4002 is manipulated, various information, such as an address book or a schedule book, is displayed on the electro-optical device D.

Note that the electronic apparatuses that employ the electro-optical device according to the aspects of the invention include, in addition to the apparatuses shown in FIGS. 13 to 15, a digital still camera, a television, a video camera, a car navigation system, a pager, an electronic personal organizer, an electronic paper, an electronic calculator, a word processor, a workstation, a video telephone, a POS terminal, a printer, a scanner, a photocopier, a video player, and devices provided with a touch panel display. In addition, applications of the electro-optical device according to the aspects of the invention are not limited to image display. For example, in an image forming apparatus, such as an optical writing type printer or an electronic copying machine, a writing head is used to expose a photoreceptor in correspondence with an image to be formed on a recording material such as a paper. The electro-optical device according to the aspects of the invention may be used as this type of writing head. The unit circuit described in the aspects of the invention not only includes a pixel circuit that forms a pixel of a display device as in the case of the above described embodiments but also includes a circuit that forms a unit of exposure in an image forming apparatus.

What is claimed is:

1. An electro-optical device comprising:

a plurality of data lines;

a plurality of scanning lines; and a plurality of unit circuits that are provided in correspondence with intersections of the data lines and the scanning lines, wherein each of the data lines is supplied with a data voltage in accordance with a gray-scale level, wherein each of the scanning lines is supplied with a scanning signal that specifies a writing period during which the data voltage is being written into the corresponding unit circuits, and wherein each of the plurality of unit circuits includes:

a driving transistor that generates a driving current in accordance with an electric potential of a gate of the driving transistor;

an electro-optical element that generates light with a gray-scale level in accordance with the driving current that is generated by the driving transistor;

a capacitive element that has a first electrode and a second electrode that is connected to the gate of the driving transistor;

a power feed line that is supplied with a constant electric potential and is, during an initialization period that is different from the writing period, electrically connected to the second electrode;

a first switching element that electrically connects the gate of the driving transistor with a drain of the driving transistor to conduct current to the gate of the driving transistor during the entire initialization period; and a second switching element that switches between conduction and non-conduction between the data line and the first electrode on the basis of the scanning signal.

2. The electro-optical device according to claim 1, wherein each of the plurality of unit circuits further includes a third switching element that switches between conduction and non-conduction between the power feed line and the first electrode and that conducts current through the power feed line with the first electrode at least during the initialization period.

3. The electro-optical device according to claim 1, wherein the third switching element is turned on when the second switching element is in an off state.

4. An electro-optical device comprising:

a plurality of data lines;

a plurality of scanning lines;

a plurality of power feed lines;

a plurality of unit circuits that are provided in correspondence with Intersections of the data lines and the scanning lines, wherein each of the data lines is supplied with a data electric potential corresponding to a gray-scale level, wherein each of the scanning lines is supplied with a scanning signal that specifies a writing period during which the data electric potential is written into the unit circuit, wherein each of the power feed lines is supplied with a constant electric potential, and wherein each of the plurality of unit circuits includes:

a driving transistor that generates a driving current corresponding to an electric potential of a gate of the driving transistor;

an electro-optical element that generates light with a gray-scale level corresponding to the driving current that is generated by the driving transistor;

a first switching element that electrically connects the gate of the driving transistor with a drain of the driving transistor to conduct current to the gate of the driving transistor during the entire initialization period;

a capacitive element that has a first electrode and a second electrode that is connected to the gate of the driving transistor;

a second switching element that switches between conduction and non-conduction between the data line and the first electrode on the basis of the scanning signal;

a third switching element that switches between conduction and non-conduction between the power feed line and the first electrode, wherein the third switching element is turned off when the second switching element is in an on state and is turned on when the second switching element is in an off state; and a fourth switching element that is connected between the first electrode and the second electrode and that switches between conduction and non-conduction between the first electrode and the second electrode.

5. The electro-optical device according to claim 4, further comprising:

a plurality of power supply lines, each of which supplies the corresponding driving transistor of each of the plurality of unit circuits with a power supply voltage, wherein the power supply lines intersect with the power feed lines at intersections; and a capacitor that is formed at each of the intersections.

6. The electro-optical device according to claim 4, wherein, in each of the plurality of unit circuits, the second switching element and the third switching element are transistors of different conductivity types, and wherein a common scanning signal is supplied to the gate of the second switching element and the gate of the third switching element.

7. An electronic apparatus comprising the electro-optical device according to claim 4.

8. The electro-optical device according to claim 1, further comprising:

a fourth switching element that is connected between the first electrode and the second electrode and that switches between conduction and non-conduction between the first electrode and the second electrode, wherein the power feed line is electrically connectable to the second electrode when the first switching element and the fourth switching element are in a conductive state.

9. The electro-optical device according to claim 4, wherein the power feed line is electrically connectable to the second electrode when the first switching element and the fourth switching element are in a conductive state.

* * * * *